US006196696B1

(12) United States Patent
Shiao

(10) Patent No.: US 6,196,696 B1
(45) Date of Patent: Mar. 6, 2001

(54) DRIVING TOOL WITH ILLUMINATING CAPABILITY

(76) Inventor: Hsuan-Sen Shiao, No. 15-1, Lane 369, Min-Chuan Rd., Taichung City (TW)

( * ) Notice: Subject to any disclaimer, the term of this patent is extended or adjusted under 35 U.S.C. 154(b) by 0 days.

(21) Appl. No.: 09/330,480

(22) Filed: Jun. 11, 1999

Related U.S. Application Data

(63) Continuation-in-part of application No. 09/307,325, filed on May 7, 1999.

(51) Int. Cl.[7] ..... B25B 23/18

(52) U.S. Cl. ..... 362/120; 362/158; 362/206; 362/267

(58) Field of Search ..... 362/109, 119, 362/120, 158, 267, 206, 205

(56) References Cited

U.S. PATENT DOCUMENTS

| | | | | |
|---|---|---|---|---|
| 2,736,792 | * | 2/1956 | Freeland | 362/120 |
| 5,515,249 | * | 5/1996 | Shiao | 362/119 |
| 5,733,034 | * | 3/1998 | Jan | 362/119 |
| 5,913,596 | * | 6/1999 | Lin | 362/120 |
| 6,030,092 | * | 2/2000 | McCalla et al. | 362/120 |

* cited by examiner

*Primary Examiner*—Alan Cariaso
(74) *Attorney, Agent, or Firm*—Sheridan Ross P.C.

(57) ABSTRACT

A driving tool includes a transparent handle, a drive shaft, a ratchet mechanism, and a torch. The handle has a tubular outer casing formed with open front and rear chambers that are isolated from each other. The drive shaft has a connecting end which extends into the front chamber, and a drive end which extends forwardly of the outer casing. The ratchet mechanism is mounted in the front chamber, and is connected operably to the connecting end such that the ratchet mechanism is operable to permit the handle to drive rotation of the drive shaft in at least one direction. The torch is received removably in the rear chamber, and includes a tubular inner housing, a lamp unit mounted at a front end portion of the inner housing, a push-button switch member mounted on a rear end portion of the inner housing, a tubular rear cap mounted securely on the rear end portion of the inner housing and having an externally threaded front section for engaging threadedly a rear end portion of the outer casing, and an open rear section for access to the switch member, a sealing ring provided on the rear cap to establish a watertight seal between the rear cap and the inner housing, and a resilient sealing member disposed rearwardly of the switch member, and sealingly retained at the rear section of the rear cap.

6 Claims, 6 Drawing Sheets

DRIVING TOOL WITH ILLUMINATING CAPABILITY

CROSS-REFERENCE TO RELATED APPLICATION

This application is a continuation-in-part (CIP) of U.S. patent application Ser. No. 09/307,325, filed on May 7, 1999, the entire disclosure of which is incorporated herein by reference.

BACKGROUND OF THE INVENTION

1. Field of the Invention

This invention relates to a driving tool, such as a screwdriver, which has an illuminating capability, more particularly to a driving tool which is provided with waterproof means to permit use of the tool in water.

2. Description of the Related Art

Referring to FIG. 1, a first conventional screwdriver 10 is shown to include a hollow handle body 11 formed with a receiving chamber 12, a pair of bulbs 132 mounted on an open front end of the handle body 11, a seater 131 mounted on the front end of the handle body 11 between the bulbs 132 for mounting of a shank 17 thereon, a battery set 14 received in the receiving chamber 12, and a switch member 15 mounted on a rear end of the handle body 10 and connected electrically to the battery set 14 and the bulbs 132. The switch member 15 is depressible to control actuation of the bulbs 132. However, since the screwdriver 10 is not provided with waterproofing means to prevent entry of water or moisture into the receiving chamber 12, it cannot be used in water or under very humid circumstances.

Referring to FIGS. 2 and 3, another conventional screwdriver 20 is shown to include a tubular handle body 21, a front cap 23 mounted on a front end portion of the handle body 21 by means of a retaining sleeve 25 that engages threadedly the front end portion of the handle body 21, a torch 22 received in the handle body 21, and a rear cap 24 mounted threadedly on a rear end portion of the handle body 21 for retaining removably the torch 22 in the handle body 21. The front cap 23 has a shank 231 mounted thereon. The rear cap 24 has a resilient central portion 241 which is depressible to permit actuation of the torch 22. The screwdriver 20 is provided with an illuminating capability, and the torch 22 is removable from the screwdriver 20 for individual use. However, the screwdriver 20 still cannot be used in water or under very humid circumstances since no waterproofing means is provided to prevent entry of water or moisture into the handle body 21.

In copending U.S. patent application Ser. No. 09/307,325, the applicant disclosed a driving tool which includes a handle, a drive shaft, and a torch. The handle has a tubular outer casing, and a transparent front cap mounted integrally and securely on a front end portion of the outer casing so as to establish a watertight seal therewith. The outer casing confines a receiving chamber with a rear opening, and has an internally threaded rear end portion. The drive shaft is fixed to the front cap, and extends forwardly therefrom. The torch is received removably in the receiving chamber, and includes a tubular inner housing, a lamp unit mounted at a front end portion of the inner housing, a push-button switch member mounted on a rear end portion of the inner housing, a tubular rear cap mounted securely on the rear end portion of the inner housing and having an externally threaded front section for engaging threadedly the rear end portion of the outer casing, and an open rear section for access to the switch member, a sealing ring provided on the rear cap to establish a watertight seal between the rear cap and the inner housing, and a resilient sealing member having a central portion which is adjacent to the switch member, and a peripheral portion sealingly retained at the rear section of the rear cap.

SUMMARY OF THE INVENTION

The main object of the present invention is to provide a driving tool of the aforesaid type that is provided with a removable torch and that is waterproof so as to be operable in water or under very humid circumstances.

Accordingly, the driving tool of the present invention includes a handle, a drive shaft, a ratchet mechanism, and a torch. The handle is formed integrally from a transparent material, and has a tubular outer casing with open front and rear end portions, and a partition wall disposed within the outer casing and transverse to an axis of the outer casing so as to divide an interior of the outer casing into front and rear chambers which are isolated from each other. The rear end portion of the outer casing is formed with an internal screw thread. The drive shaft has a connecting end which extends into the front chamber of the handle via the open front end portion of the outer casing, and a drive end which extends forwardly of the outer casing. The ratchet mechanism is mounted in the front chamber of the outer casing of the handle, is connected operably to the connecting end of the drive shaft, and is operable to permit the handle to drive rotation of the drive shaft in at least one direction. The torch is received removably in the rear chamber of the handle, and includes a tubular inner housing, a lamp unit mounted in the inner housing at a front end portion of the latter, a push-button switch member mounted on a rear end portion of the inner housing, a tubular rear cap mounted securely on the rear end portion of the inner housing, a sealing ring, and a sealing member. The switch member is associated operably with the lamp unit to control activation of the lamp unit. The rear cap has an externally threaded front section which extends into the outer casing of the handle via the open rear end portion of the latter for engaging threadedly the rear end portion of the outer casing, and an open rear section for access to the switch member. The sealing ring is provided on the rear cap to establish a watertight seal between the rear cap and the inner housing. The sealing member is disposed rearwardly of the switch member, and has a central portion disposed adjacent to the switch member, and a peripheral portion sealingly retained at the rear section of the rear cap to establish a watertight seal between the rear cap and the inner housing. The central portion of the sealing member is depressible to permit actuation of the switch member.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
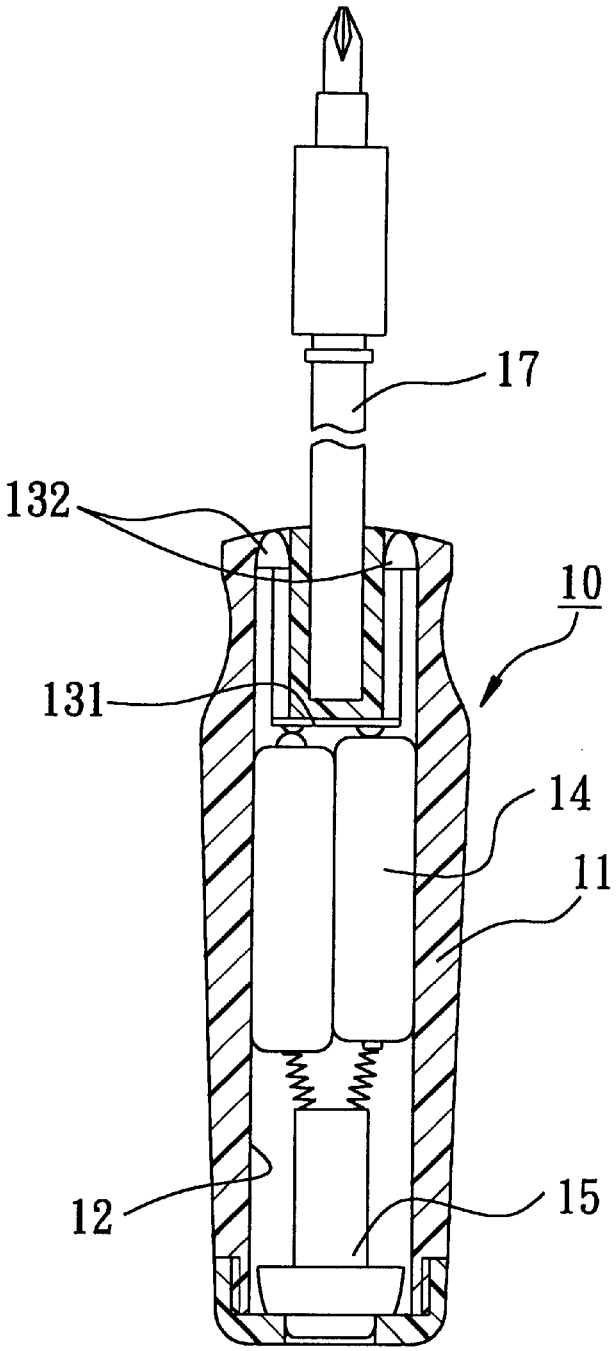
FIG. 1 PRIOR ART
FIG. 1 is a sectional view of a conventional screwdriver.
Figure 2:
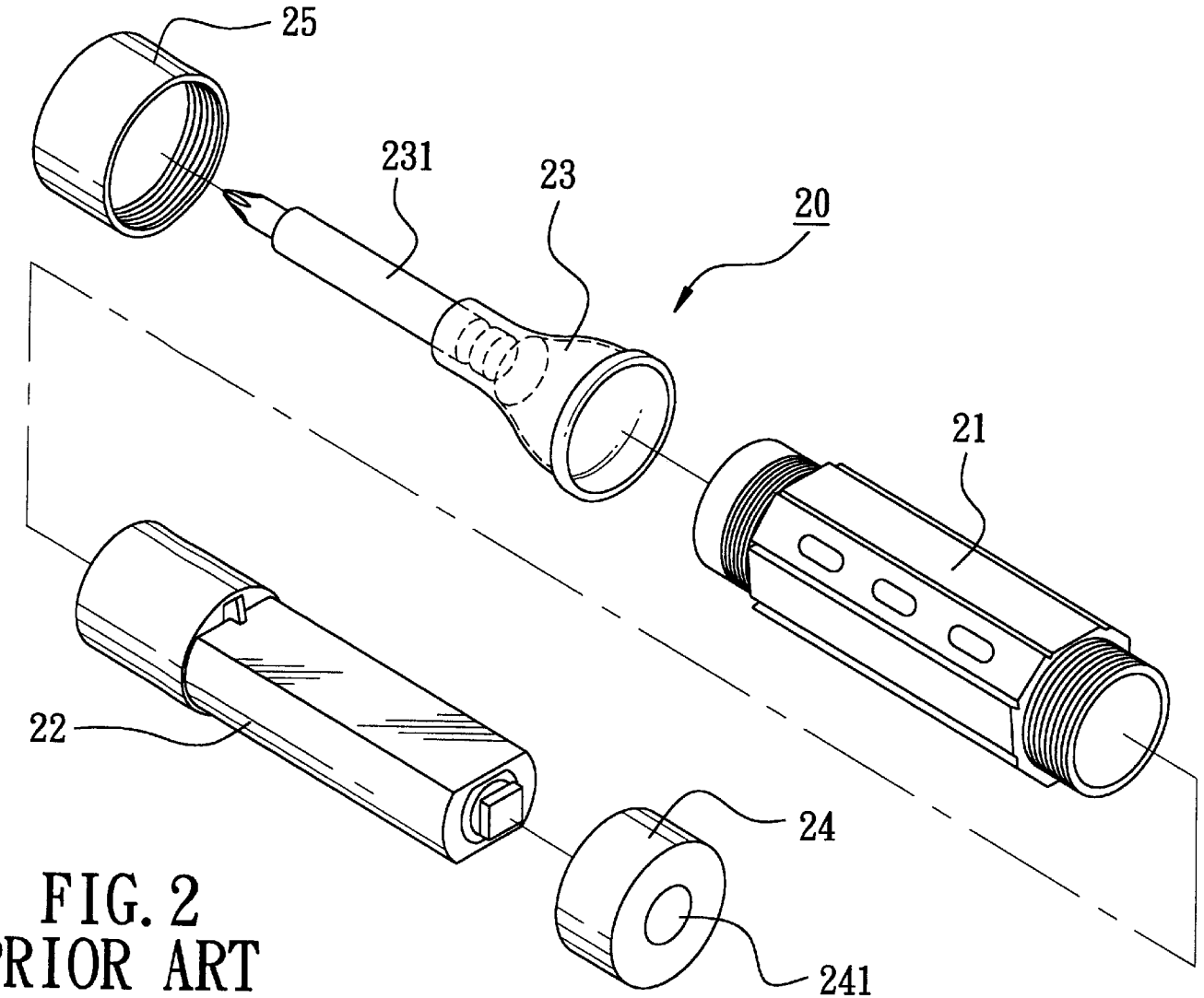
FIG. 2 PRIOR ART
FIG. 2 is an exploded perspective view of another conventional screwdriver.
Figure 3:
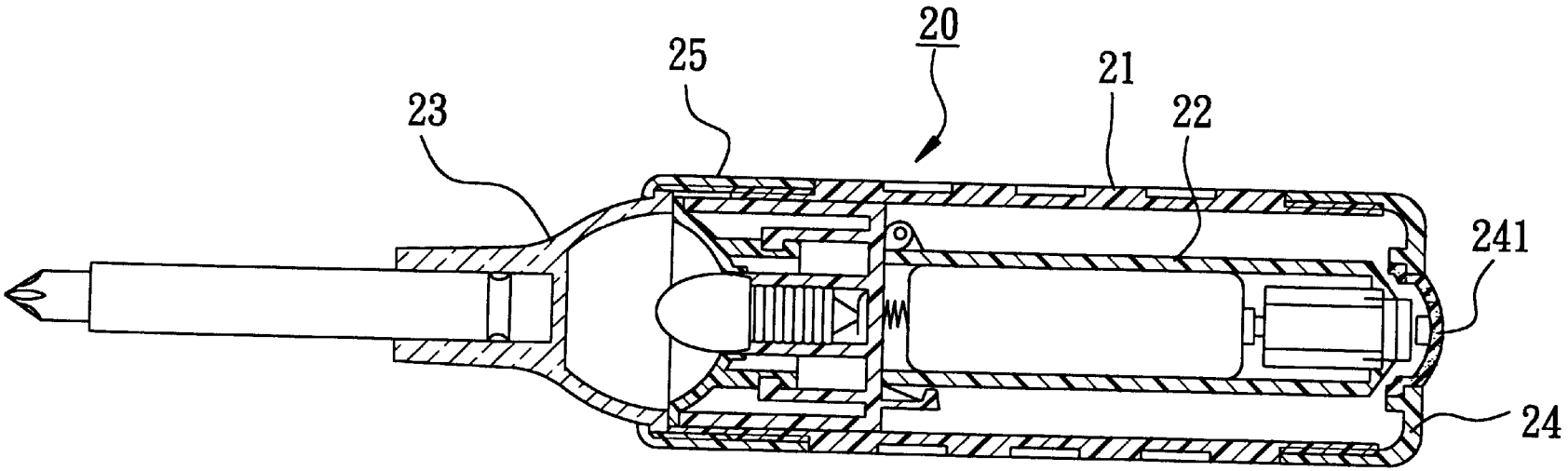
FIG. 3 PRIOR ART
FIG. 3 is a sectional view of the conventional screwdriver of FIG. 2.
Figure 4:
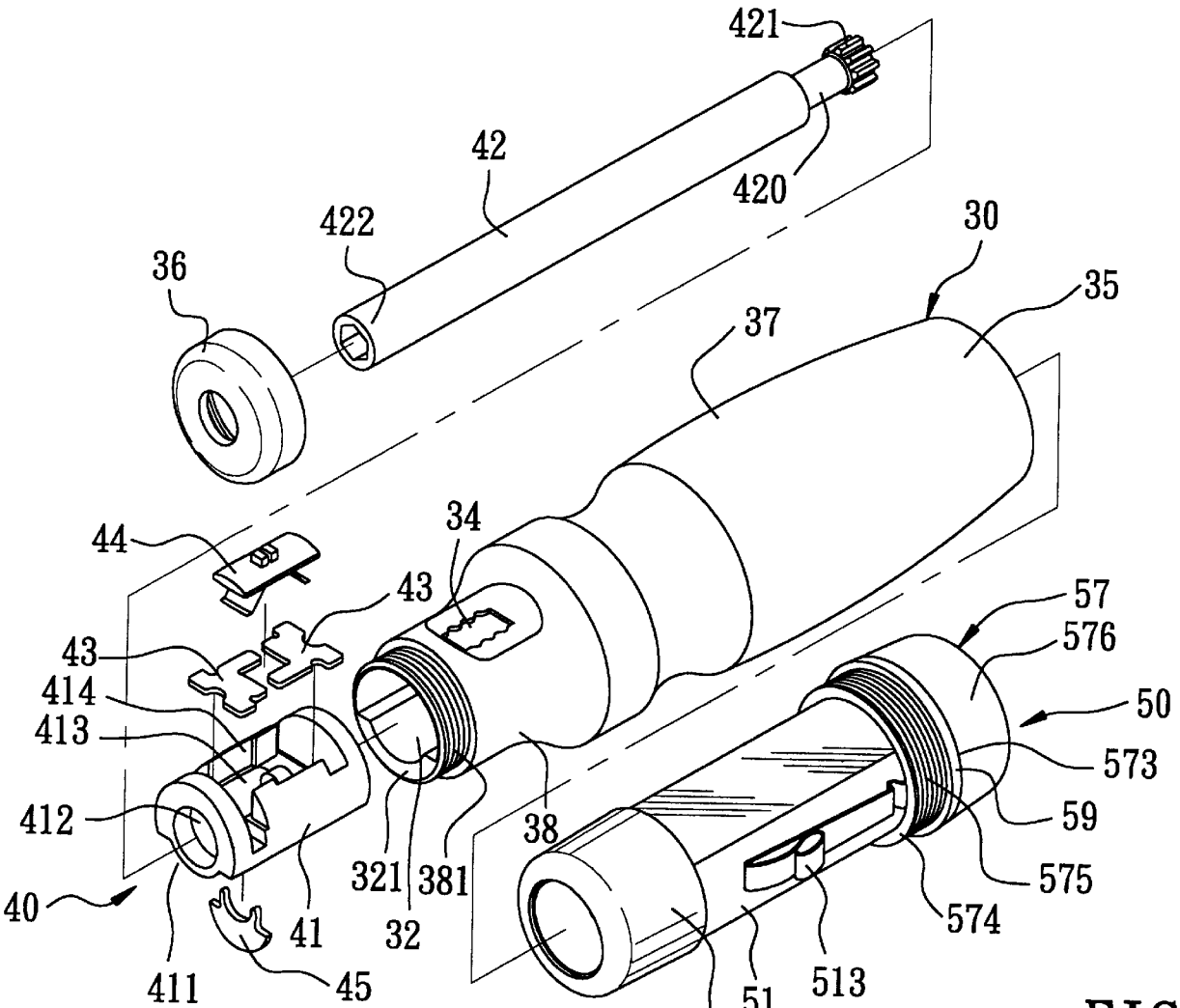
FIG. 4 is an exploded perspective view of a preferred embodiment of the driving tool of the present invention.
Figure 5:
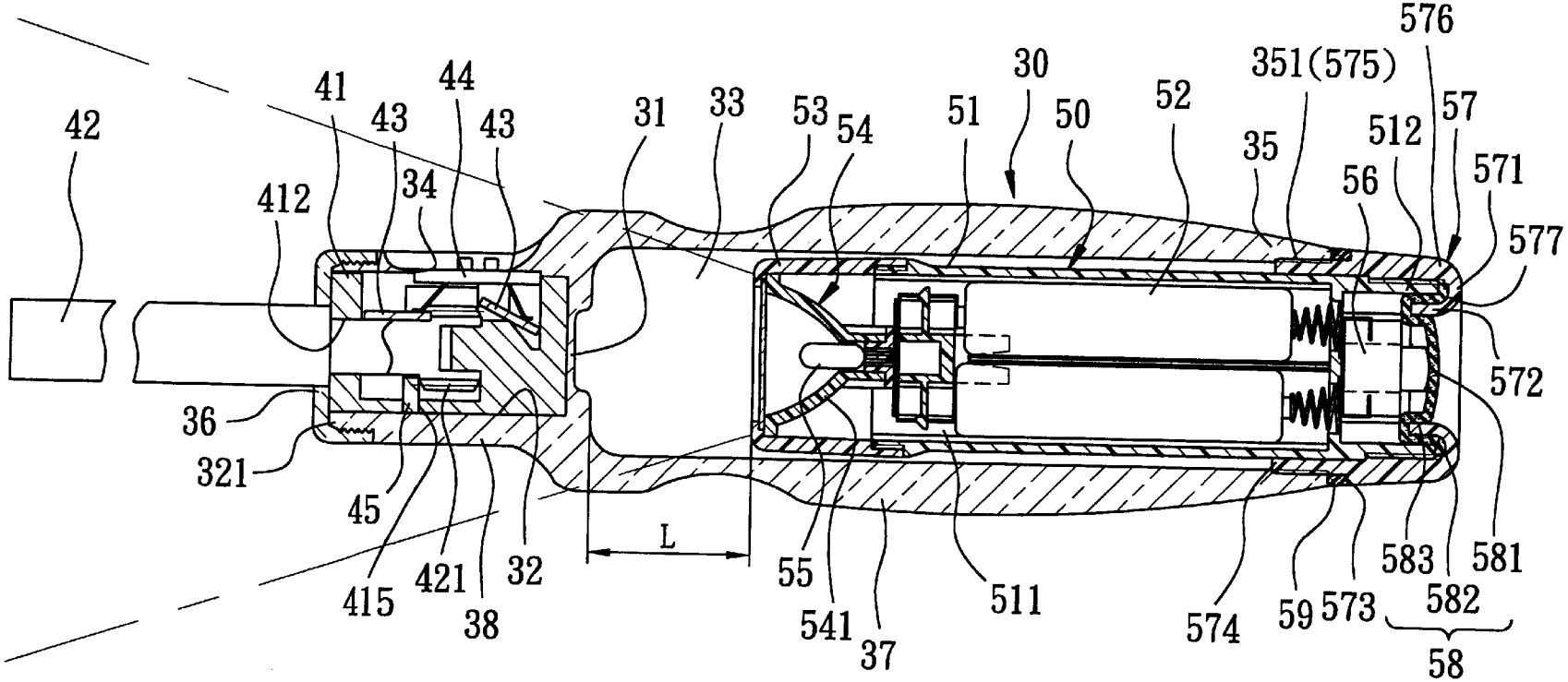
FIG. 5 is a sectional view of the preferred embodiment.

Referring to FIGS. 4 and 5, the preferred embodiment of the driving tool of the present invention is shown to include a tubular handle 30, a drive shaft 42, a ratchet mechanism 40, and a torch 50.

The handle 30 is formed integrally from a transparent material, such as acrylate. The handle 30 has a tubular outer casing 37 with open front and rear end portions 38, 35, and a partition wall 31 which is disposed within the outer casing 37 and which is transverse to an axis of the outer casing 37 for dividing an interior of the outer casing 37 into a front chamber 32 and a rear chamber 33 that are isolated from each other in a watertight manner. The front chamber 32 is provided with an axially extending positioning block 321 therein. The positioning block 321 is formed as a sector of a ring, and is fixed to the outer casing 37. The front end portion 38 of the outer casing 37 is formed with an external screw thread 381 for mounting a front cap 36 thereon. The rear end portion 35 of the outer casing 37 is formed with an internal screw thread 351. The outer casing 37 further has a surrounding wall formed with an axially extending radial opening 34 which is disposed adjacent to and which is communicated with the front chamber 32.

The drive shaft 42 has a connecting end 420 extending into the front chamber 32 via an axial opening in the front end portion 38 of the outer casing 37, and a drive end 422 which extends forwardly of the outer casing 37 for mounting a tool bit (not shown) thereon.

The ratchet mechanism 40 is mounted in the front chamber 32 of the outer casing 37 of the handle 30. The ratchet mechanism 40 includes an elongated ratchet housing 41, a ratchet wheel 421 fixed on the connecting end 420 of the drive shaft 42, two pawl members 43, a stop plate 45, and a slidable actuator 44.

The ratchet housing 41 is disposed in the front chamber 32, and has a bottom end formed with a positioning groove 411 that complements the shape of the positioning block 321 so as to permit co-rotation of the ratchet housing 41 with the handle 30. The ratchet housing 41 is formed with an axially extending cavity 413, a peripheral slot 414 communicated with the cavity 413 and aligned with the radial opening 34 in the outer casing 37 of the handle 30, and a circumferential groove 415 for receiving the stop plate 45. The ratchet housing 41 further has an axial front opening 412 communicated with the cavity 413 to permit extension of the connecting end 420 of the drive shaft 42 into the cavity 413. The stop plate 45 engages one side of the ratchet wheel 421 on the drive shaft 42 to prevent axial movement of the drive shaft 42 relative to the ratchet housing 41. The pawl members 43 are disposed in the cavity 413. The sliding actuator 44 is received in the peripheral slot 414, and is operable slidingly to engage selectively the pawl members 43 with the ratchet wheel 421 on the drive shaft 42 so as to permit the handle 30 to drive rotation of the drive shaft 42 in a first direction and permit idle rotation of the handle 30 with respect to the drive shaft 42 in a second direction opposite to the first direction, or to permit the handle 30 to drive rotation of the drive shaft 42 in both directions. The sliding actuator 44 extends through the radial opening 34 in the outer casing 37 of the handle 30 to permit operation thereof. The front cap 36 is mounted threadedly on the front end portion 38 of the handle 30 to prevent removal of the ratchet housing 41 from the front chamber 32 of the handle 30.

The torch 50 is received in the rear chamber 33 of the handle 30, and includes a tubular inner housing 51, a lamp unit 54, a push-button switch member 56, a tubular rear cap 57, a sealing ring 59, and a resilient sealing member 58. The inner housing 51 has a front end portion with a front cover 53 mounted thereon, and a rear end portion 512 with the rear cap 57 mounted securely thereon. The inner housing 51 confines a cell compartment 511 adapted for receiving a cell unit 52 therein. The lamp unit 54 is mounted on the front end portion of the inner housing 51 inside the front cover 53 and proximate to the partition wall 31 of the handle 30, and includes a bulb 55 and a reflector 541 disposed around the bulb 55. As shown, a distance (L) is defined between the front cover 53 and the partition wall 31 such that the lamp unit 54 is spaced apart from the partition wall 31. The switch member 56 is disposed inside the inner housing 51, and is mounted in the rear end portion 512 of the inner housing 51 and proximate to the rear cap 57. The switch member 56 is connected electrically to the lamp unit 54, and is operable to control activation of the lamp unit 54.

The rear cap 57 has a front section 574 which extends into the rear end portion 35 of the outer casing 37 of the handle 40 via a rear opening of the latter and which is formed with an external screw thread 575 for engaging the internal screw thread 351 on the rear end portion 35 of the outer casing 37. The rear cap 57 further has an open rear section 576 for access to the switch member 56. The rear section 576 has an outer diameter larger than that of the front section 574 so as to form a shoulder 573 between the front and rear sections 574, 576. The sealing ring 59 is sleeved on the front section 574 of the rear cap 57 immediately adjacent to the shoulder 573, and is clamped between an end face of the rear end portion 35 of the outer casing 37 of the handle 30 and the shoulder 573 when the rear cap 57 engages threadedly the rear end portion 35 of the outer casing 37 so as to establish a watertight seal between the front section 574 of the rear cap 57 and the outer casing 37 of the handle 30 to prevent entry of water or moisture into the rear chamber 33 from between the rear cap 57 and the rear end portion 35 of the outer casing 37. The rear section 576 of the rear cap 57 is formed with an annular rim which has a first section 571 that extends radially and inwardly from a rear edge of the rear section 576 of the rear cap 57, and a second section 572 that extends axially and forwardly from the first section 571 and into the inner housing 51 of the torch 50. The annular rim cooperates with the rear end portion 512 of the inner housing 51 to define a clamping space 577 therebetween.

The sealing member 58 is made of a resilient material, such as rubber, and is disposed rearwardly of the switch member 56. The sealing member 58 has a circular central portion 581 disposed adjacent to the switch member 56, and a peripheral portion 582 extending into the clamping space 577 so as to be clamped between the annular rim of the rear cap 57 and the rear end portion 512 of the inner housing 51. The sealing member 58 has a rear side formed with an annular engaging groove 583 between the central portion 581 and the peripheral portion 582. The second section 572 of the annular rim of the rear cap 57 extends fittingly into the engaging groove 583 for engaging the sealing member 58. The sealing member 58 is thus sealingly retained at the rear section 576 of the rear cap 57 to establish a watertight seal between the rear section 576 of the rear cap 57 and the inner housing 51.

As shown in FIG. 5, since a distance (L) is formed between the the front cap 53 of the torch 50 and the partition wall 31 of the handle 30, the light beam generated by the lamp unit 54, which diverges forwardly, can be prevented from being blocked by the ratchet mechanism 40 mounted on the front end portion 38 of the handle 30 so as to be capable of illuminating a front side of the driving tool.

With the provision of the partition wall 31, the sealing ring 59 and the sealing member 58, water and moisture can be prevented from entering into the rear chamber 33 and the cell compartment 511, thereby ensuring the illuminating capability of the driving tool even when the latter is used in water or under very humid circumstances.

Figure 6:
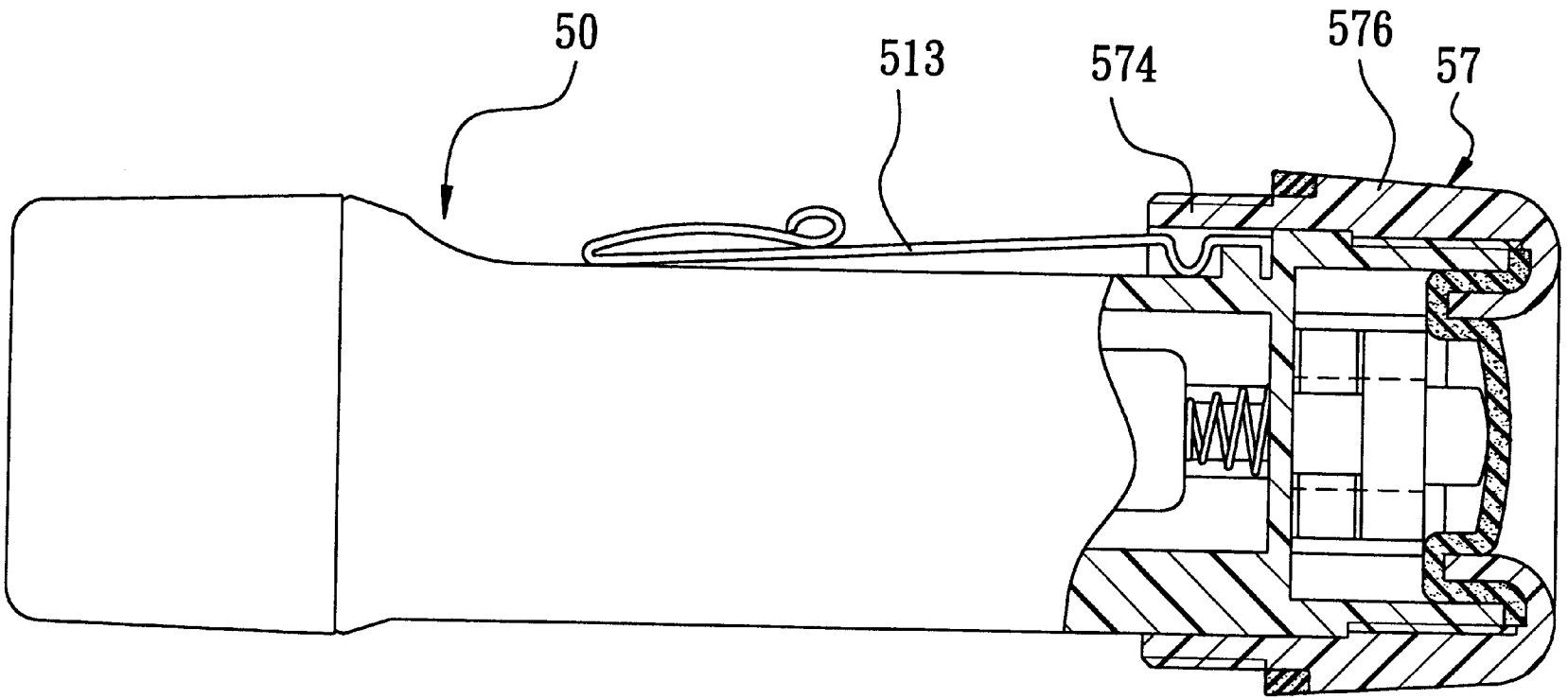
FIG. 6 is a partly sectional view of a torch of the driving tool of the preferred embodiment.

Referring to FIGS. 4 and 6, to use the torch 50 separately, the torch 50 is threaded out of the outer casing 37 of the handle 40 to disengage the external screw thread 575 of the rear cap 57 from the internal screw thread 351 of the rear end portion 35 of the outer casing 43. The inner housing 51 has an outer surface provided with a clip 513 such that the torch 50 can be hooked on a pocket of the user to facilitate carrying of the same.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A driving tool comprising:

a handle formed integrally from a transparent material and having a tubular outer casing with open front and rear end portions, and a partition wall disposed within said outer casing and transverse to an axis of said outer casing so as to divide an interior of said outer casing into front and rear chambers which are isolated from each other, said rear end portion of said outer casing being formed with an internal screw thread;

a drive shaft having a connecting end which extends into said front chamber of said handle via said open front end portion of said outer casing, and a drive end which extends forwardly of said outer casing;

a ratchet mechanism mounted in said front chamber of said outer casing of said handle, said ratchet mechanism being connected operably to said connecting end of said drive shaft and being operable to permit said handle to drive rotation of said drive shaft in at least one direction; and a torch received removably in said rear chamber of said handle, said torch including:

a tubular inner housing having a front end portion and a rear end portion, a lamp unit mounted in said inner housing at said front end portion of said inner housing, a push-button switch member mounted on said rear end portion of said inner housing and associated operably with said lamp unit to control activation of said lamp unit, a tubular rear cap mounted securely on said rear end portion of said inner housing, said rear cap having an externally threaded front section which extends into said outer casing of said handle via said open rear end portion of said outer casing for engaging threadedly said rear end portion of said outer casing, and an open rear section for access to said switch member, a sealing ring provided on said rear cap to establish a watertight seal between said rear cap and said inner housing, and a resilient sealing member disposed rearwardly of said switch member, said sealing member having a central portion disposed adjacent to said switch member, and a peripheral portion sealingly retained at said rear section of said rear cap to establish a watertight seal between said rear cap and said inner housing, said central portion of said sealing member being depressible to permit actuation of said switch member; wherein said rear section of said rear cap is formed with an annular rim which has a first section that extends radially and inwardly from said rear section, and a second section that extends axially and forwardly from said first section into said inner housing of said torch, said annular rim cooperating with said rear end portion of said inner housing of said torch to form a clamping space therebetween, said peripheral portion of said sealing member extending into said clamping space so as to be clamped between said annular rim and said rear end portion of said inner housing, said sealing member having a rear side formed with an annular engaging groove around said central portion, said second section of said annular rim extending fittingly into said engaging groove of said sealing member.

2. The driving tool according to claim 1, wherein said inner housing of said torch has an outer surface provided with a clip.

3. The driving tool according to claim 1, wherein said ratchet mechanism includes an elongated ratchet housing disposed in said front chamber and mounted on said outer casing of said handle for co-rotation therewith, said ratchet housing being formed with an axially extending cavity with a front opening, said connecting end of said drive shaft extending into said cavity via said front opening, said ratchet mechanism further including a ratchet wheel mounted on said connecting end of said drive shaft, two pawl members disposed in said cavity, and an actuator mounted movably on said ratchet housing and associated operably with said pawl members such that operation of said actuator can engage a selected one of said pawl members with said ratchet wheel and disengage the other one of said pawl members from said ratchet wheel.

4. The driving tool as claimed in claim 3, wherein said ratchet housing has a peripheral slot communicated with said cavity, said outer casing being formed with a radial opening aligned with said peripheral slot, said actuator of said ratchet mechanism being mounted on said ratchet housing at said peripheral slot and extending through said radial opening to permit operation thereof.

5. The driving tool as claimed in claim 1, wherein said front end portion of said inner housing of said torch is spaced apart from said partition wall.

6. The driving tool as claimed in claim 1, further comprising a front cap mounted on said front end portion of said outer casing of said handle for retaining said ratchet mechanism in said front chamber.

* * * * *